United States Patent [19]

DiVincenzo

[11] Patent Number: 4,568,615

[45] Date of Patent: Feb. 4, 1986

[54] CRAFT SUBSTRATES

[76] Inventor: Maureen DiVincenzo, 1003 Wachusett St., Holden, Mass. 01520

[21] Appl. No.: 544,436

[22] Filed: Oct. 21, 1983

[51] Int. Cl.[4] ..... D05C 1/00

[52] U.S. Cl. ..... 428/542.8; 428/906; 428/131; 112/439; 112/266.1

[58] Field of Search ..... 428/906.6, 131, 134, 428/137, 542.8; 112/439, 266.1

[56] References Cited

U.S. PATENT DOCUMENTS

| | | | |
|---|---|---|---|
| 1,418,846 | 6/1922 | Stevens | 428/906.6 X |
| 2,059,653 | 11/1936 | Pretzfelder | 428/131 |
| 2,961,009 | 11/1960 | Feliks | 28/143 |
| 3,240,176 | 3/1966 | Morrison | 112/266.1 |
| 3,421,969 | 1/1969 | Roode et al. | 428/906.6 X |
| 3,704,194 | 11/1972 | Harrier | 428/131 X |
| 4,044,437 | 8/1977 | Ebenstein | 28/151 |
| 4,091,925 | 5/1978 | Griffo et al. | 428/134 X |
| 4,372,238 | 2/1983 | Ciganko | 28/151 X |
| 4,404,750 | 9/1983 | Marx et al. | 428/906.6 X |

*Primary Examiner*—George F. Lesmes
*Assistant Examiner*—Nancy A. B. Swisher
*Attorney, Agent, or Firm*—Norman S. Blodgett; Gerry A. Blodgett

[57] ABSTRACT

A substrate or "canvas" for use in thread-craft is formed of stiffenable sheet-like material in a chosen three-dimensional surface configuration. The substrate is needle-penetrable throughout, or in a dense array of points. The points are arranged so as to be amenable to embroidery charting. The substrate interior is accessible for thread-tool manipulation.

3 Claims, 15 Drawing Figures

CRAFT SUBSTRATES

BACKGROUND OF THE INVENTION

A variety of useful and ornamental manufactures have been long produced in the art of embroidery by the application of colored threads to flat sheets of fabric. This decorative art has included the production of representational, decorative, abstract, and even textual patterns. Some of the tools and techniques of this art, the needles, hooks, and stitches, are known from antiquity. Other techniques, tools, and especially, materials continue to be discovered and exploited. For instance, the substitution of synthetic for natural fibers in the thread and continuous fabrics for woven fabrics in the substrate sheet have widened the horizons of this useful art.

The actual products of the craft have always, however, been limited to substantially two-dimensional representations, and to very low relief. Attempts to produce an illusion of depth by simulated perspective even in the hands of master craftpersons have lead to primitive looking results. The essays of the amateur, although charming are often even less successful.

This and other difficulties with the prior substrates have been obviated in a novel manner by the present invention.

It is, therefore, an outstanding object of the invention to provide a substrate for thread craft which provides a basis for fully three-dimensional product.

Another object of this invention is the provision of a substrate for thread craft which assures a properly shaped three-dimensional end-product even for an amateur craftsperson, while giving free reign to individuality and creativity in color choice and decoration.

A further object of the present invention is the provision of a self-supporting three-dimensional substrate for thread craft which supplies the basis for a compactly marketable and shippable craft kit, well suited for mail-order sale.

It is another object of the instant invention to provide a method for forming a substrate for thread craft which lends itself to inexpensive mass-production methods.

A still further object of the invention is the provision of a substrate for thread craft which functions as an informative and useful closure for a storage container.

With these and other objects in view, as will be apparent to those skilled in the art, the invention resides in the combination of the parts set forth in the specification and covered by the claims appended hereto.

SUMMARY OF THE INVENTION

The invention is a substrate or "canvas" for needle and thread craft made of a stiffened fabric or sheet shaped into a stable three-dimensional pattern and which will allow the penetration of a thread working tool, either throughout the surface, or at least at a dense array of locations on the surface.

The invention also involves a novel combination of the substrate with an assortment of threads and an assortment of craft tools to form a craft kit. The invention further involves a combination of the substrate with the elements of a mason-type jar, the substrate taking the place of the usual vacuum test plate to create a decorative and easily identified container.

The invention further involves a method and apparatus for injection-vacuum- or blow-molding a substrate, the cavity of the mold being provided with a plurality of protrusions, substantially in the line of draft, which produce the dense array of needle penetrable points.

BRIEF DESCRIPTION OF THE DRAWINGS

The character of the invention, however, may be best understood by reference to one of its structural forms, as illustrated by the accompanying drawings, in which.

DESCRIPTION OF THE PREFERRED EMBODIMENT

Figure 1:
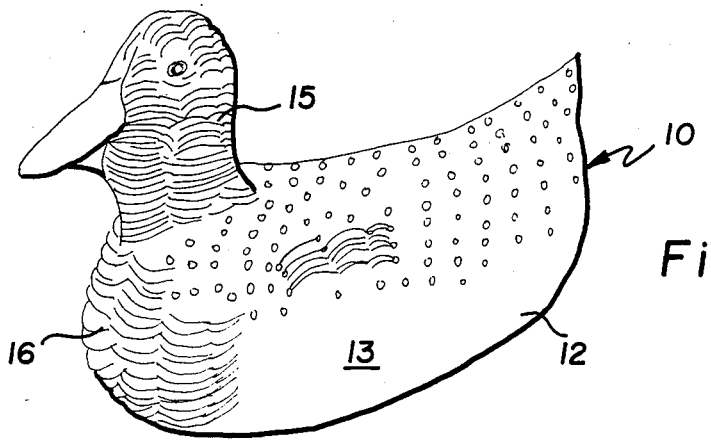
FIG. 1 is a perspective of a substrate for needlework according to the present invention.
Figure 2:
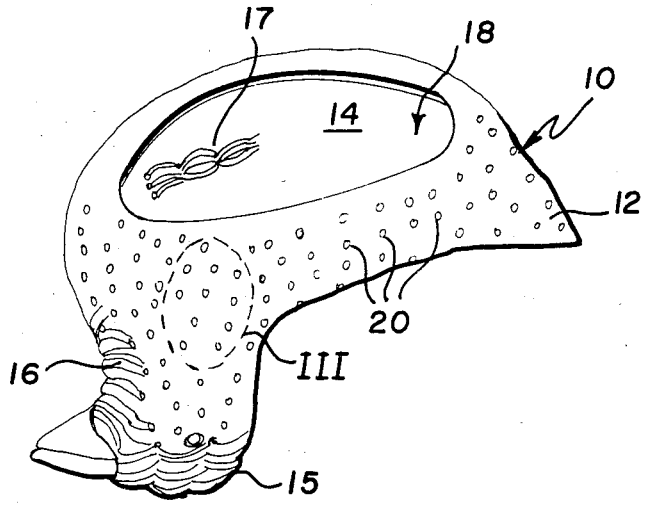
FIG. 2 is a perspective from below of the substrate.

Referring first to FIGS. 1 and 2, wherein the general features of the invention are best shown, a substrate for thread craft is indicated generally by the numeral 10. The substrate is seen to be formed of a stiffened, sheet-like material 12, shaped into a stable three-dimensional configuration. The configuration of this embodiment is a "duck" shape, with an outer surface 13 having the appearance of a duck, and a hollow interior with an inner surface 14. Both figures show a substrate partly decorated with an application of colored threads 15 thru 17 in appropriate patterns. A large opening 18 is provided, sufficiently wide to allow the insertion of the fingers or a hand to manipulate thread and tools inside the substrate.

The sheet like material is characterized by penetrability of a needle or other thread bearing tool using only reasonable manual force. The material may have this characteristic substantially throughout, or only at certain locations such as those designated by the reference number 20 in FIG. 2.

Figure 3:
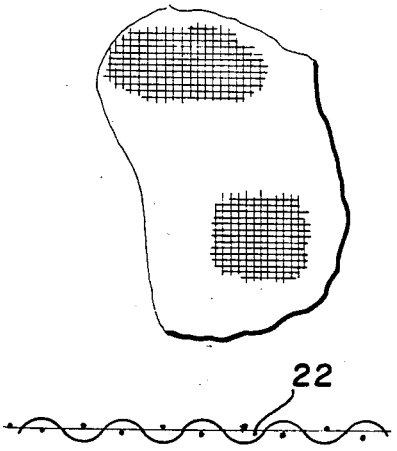
FIGS. 3 thru 5 are details of alternative constructions of the fabric from which the substrate is formed, FIG. 6 indicates the mode of penetration of the needle through one of the points of the dense array.

The alternative modes of penetrability are exemplied by the details (shown in FIGS. 3 thru 5) of the area labeled III in FIG. 2.

The sheet-like material or fabric may be a plastic material stiff enough to hold its shape, and thin enough to be everywhere penetrable by a thread bearing tool. Or, as in FIG. 3, it may be a woven fabric which has been stiffened by the application of sizing 22, such as starch, glue, resins, or the like. Such a woven substrate would also be substantially continuously penetrable by tools. It is shaped by pressing it against a male or female pattern or by pressing it between a male and a female form and allowing the sizing to harden.

Figure 4:
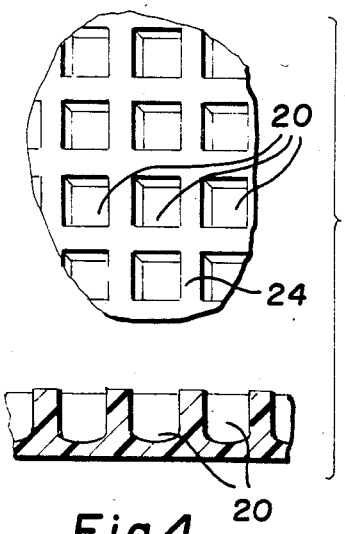
Figure 5:
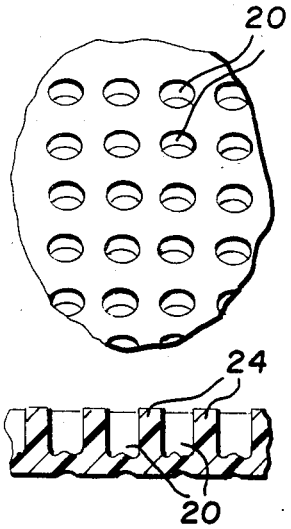

In the preferred embodiment, the substrate is formed of a generally thick shell with a dense array of points or locations which are thinner, to allow the easy passage of a thread bearing tool. In FIG. 4, these points 20 are embodied in a regular array of square indentations, which result in thin points 20 in a thicker background matrix. Other shapes for the indentations may at times be preferred, as such the round embodiment shown in FIG. 5. For most substrates, a density of about 7 mesh (seven indentations per linear inch) is preferred. For some applications discussed below, a higher density of about 10 mesh is desirable.

Figure 6:
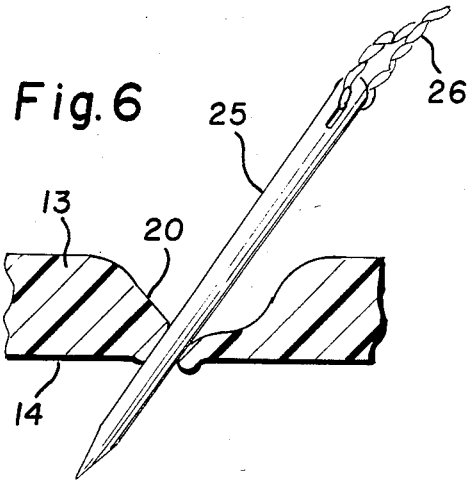

The substrate is utilized in embroidery or thread craft by running colored threads from one point to another on the substrate in sufficient numbers to form patches or lines of color. If an embroidery chart is being used to duplicate a pre-designed pattern, the use of the indentations of FIGS. 4 and 5 facilitates the reproduction of the charted pattern. As FIG. 6 suggests, passing the needle 25 and thread 26 through a point on the substrate is facilitated, by the indentation 20. This aids in the faithful reproduction of the pattern represented by the chart.

Figure 7:
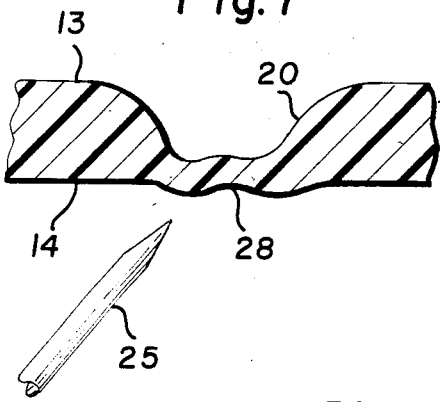
FIG. 7 illustrates the positioning of a needle at a distinctive surface shape at a point on the inner surface corresponding to a point in the dense array.

In many forms of thread craft, the tool is passed completely through the substrate inwardly and then passed outwardly at another location. As shown in FIG. 7, accurate placement of the latter passage is aided by an indication on the inner surface of the substrate corresponding to an indentation 20 on the outer surface 13. The thinness of the substrate at this point may itself be discernable by a prodding with the point of the needle 25 or other tool. The spot may also be positively marked by a concave dimple 28 on the inside surface.

Figure 8:
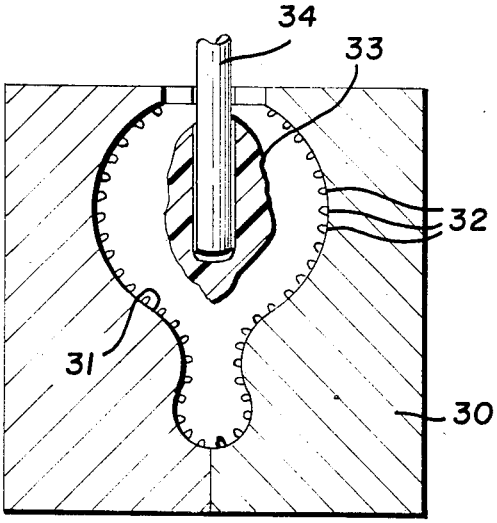
FIGS. 8 and 9 illustrate two stages in the blow-molding of the substrate.

The substrate described above may be made by a fluid-pressure differential molding process, either vacuum-or blow-molding. In FIG. 8, a split blow-mold 30 has a cavity 31. The wall of the cavity is arrayed with a plurality of protrusions 32 over most of its surface, the density of the protrusions corresponding to the desired mesh of the substrate indentations. This cavity with its protrusions may be formed in any of the common manners: positive or negative casting, hobbing, machining, etc. However, the desired relief may be economically produced by a masked etching process using photoresist. The etching process may be iterated in known manners until the required etched depth (or protrusion height) is attained.

Figure 9:
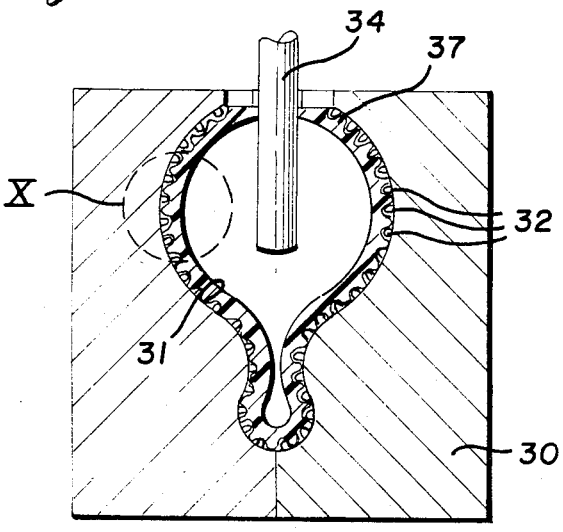
Figure 10:
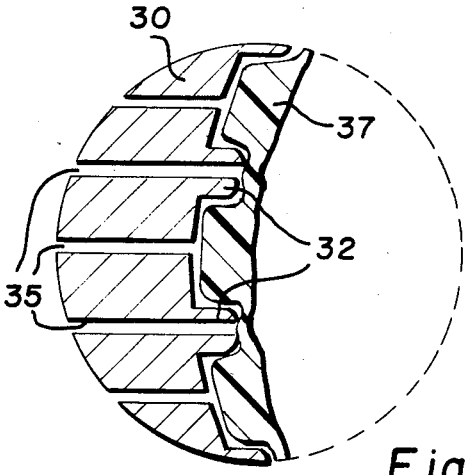
FIG. 10 is a cross sectional detail of the mold cavity wall.

A parison or blank 33 of soft polymeric or other plastic material is formed around an air tube 34. The blank is expanded by air pressure to the walls of the cavity in the usual manner as shown in FIG. 9. In FIG. 10, a detail of the area labeled X in FIG. 9, the polymeric material, still soft, is shown being shaped by the protrusions on the wall of the cavity into the desired configuration. The air in the cavity is evacuated through vents 35. The expanding blank 33 becomes the rough substrate 37. The plastic stretches thin over the protrusions, with the excess plastic pooling in the areas between the protrusions. The polymeric material is stiffened (for example by cooling) until it holds the shape thus formed. If the protrusion are rectangular, and rectangularly arrayed, a substrate will be formed as in FIG. 1, having an array of indentations as shown in FIG. 4, of the chosen mesh. The opening 18 seen in FIG. 2 may be cut by hand or automatically, preferably around the entry point of the air tube 34.

Figure 11:
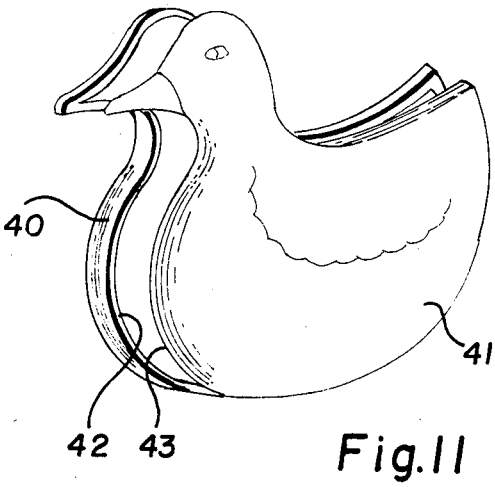
FIG. 11 shows the splitting of the molded product into a first and second shell.

Rather than cutting an access opening, such as 18, in each substrate unit, the substrates may be formed as two or more "shells" adapted to be joined together to form a closed, continuous, three-dimensional shape. For example, in FIG. 11, the rough substrate produced by the molding process is split into a first shell 40 and a second shell 41 along a dividing plane. The inside of each shell is readily accessible for manipulating thread and thread-handling tools when needlework is done on the individual shells. They may afterwards be rejoined along their corresponding edges 42 and 43.

Figure 12:
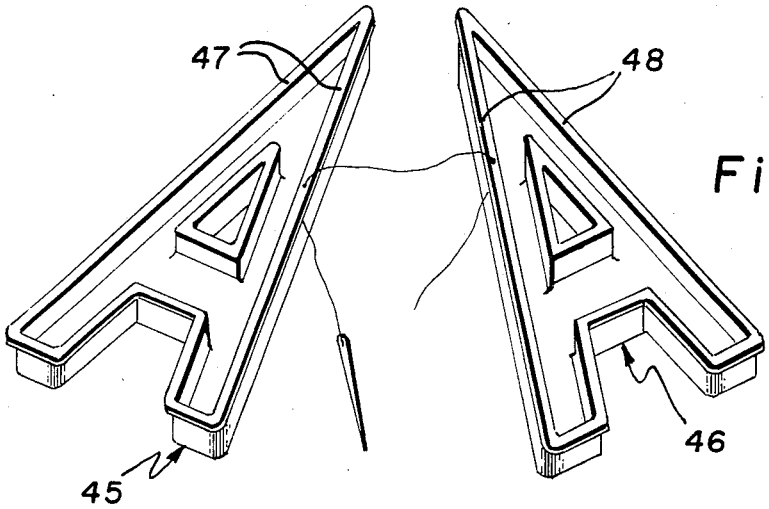
FIG. 12 illustrates a method of joining the first and second shells after they have been embellished

The shells of such a substrate may also be formed separately. For example, favorite subjects of needle and thread work are embellished numbers, monograms, and initials. FIG. 12 shows a thread craft substrate in the form of a three-dimensional letter "A". Such a substrate could be blow molded and split as was the duck in FIG. 11. Alternatively, the first and second shells 45 and 46 may be formed or molded separately. They may be produced by vacuum molding. In this case, the cavity of the vacuum mold should be provided with protrusions 32 and vents 35 as in FIG. 10. The two shells are decorated by needlework and then joined at their corresponding edges 47 and 48 by more thread work as shown or by clips or the like.

Figure 13:
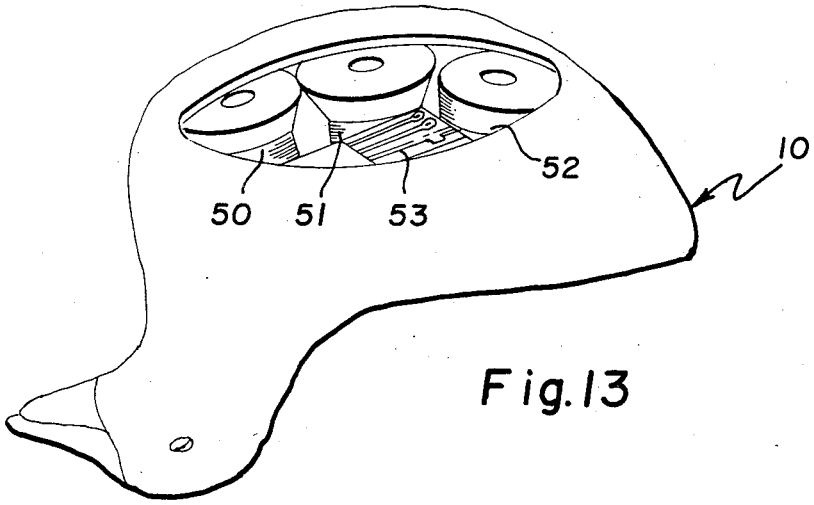
FIG. 13 shows an assembled craft kit according to an embodiment of the present invention.

As shown in FIG. 13, a novel craft kit is formed by the combination of a hollow substrate 10 of the type described above with a plurality of lengths of colored thread, such as 50, 51, 52, and an assortment of thread manipulating tools 53. Such a combination is well adapted for storage, shipping, and attractive display.

Figure 14:
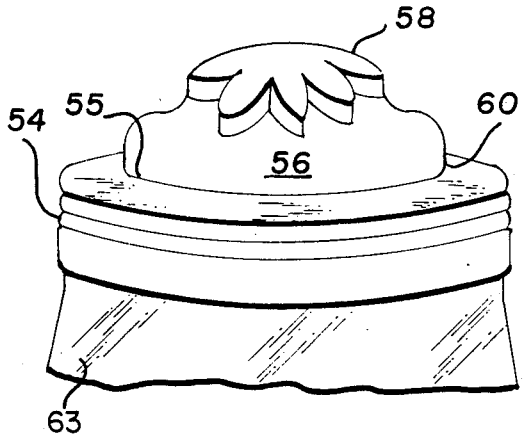
FIG. 14 shows a storage jar lid embodying the present invention.
Figure 15:
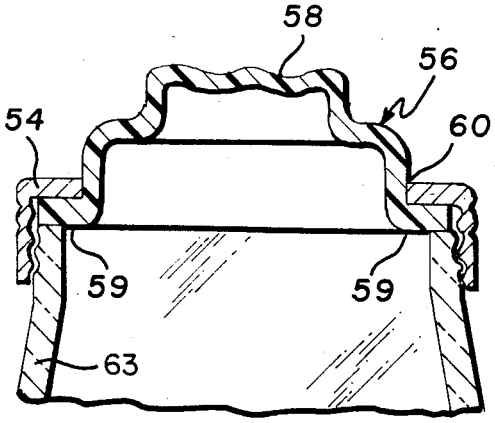
FIG. 15 is a cross section of the lid.

A substrate according to the present invention may also be combined with some of the elements of a mason-type jar to give rise to an attractive and novel container. As illustrated in FIG. 14 and in cross-section in FIG. 15, the usual mason-type jar includes a threaded glass base 63 and a threaded cap 54 which has a large circular opening 55 in the top. In normal use for food canning, an annular rubber seal and a thin metal disc are interposed between the glass base and the cap. The present invention involves, instead, the combination with the base and the cap of a substrate as described above, labeled 56 in FIGS. 14 and 15, formed into a cap insert. It is formed into a section of high relief 58 and an annular lip 59. In this form, the substrate is best formed by vacuum-molding, in which case the lip is formed by material left over from the usual sheet-like blank. This substrate can, however, be fored by hand, by die stamping, blow-molding, injection-molding, etc. The cap insert substrate may incorporate a vertical band section 60 between the lip and the high release section so configured (as by proper dimensioning) to fit tightly in the cap opening 55 when the high relief section 58 is pushed through. This holds the insert in the cap to form an integral closure. The annular lip section 59 should have an outer diameter about the same as the inner diameter of the cap and be thick enough to take the place of the former rubber seal and metal vacuum test disc. Instead however, these latter elements may be retained, as when the jar is used to store somewhat perishable materials.

The small dimensions of a substrate in this form may necessitate the use of a density of indentations of around 10 mesh, instead of the 7 mesh preferred for larger substrates.

Any of the substrates described may be molded in the form of sheets, each sheet having either a number of replicates of the same shape, or a variety of shapes. This allows, for example, the marketing of a sheet containing several letters and numerals, from which the user may choose appropriate ones. As another example, a sheet of cap insert substrates may include several shapes for creating a variety of containers: a fruit shape; a flower; a rainbow; a Christmas tree, wreath, or star; words like "Dad" or "Mom"; etc.

It is obvious that minor changes may be made in the form and construction of the invention without departing from the material spirit thereof. It is not, however, desired to confine the invention to the exact form herein shown and described, but it is desired to include all such as properly come within the scope claimed.

The invention having been thus described, what is claimed as new and desired to secure by Letters Patent is:

1. A craft kit, comprising:

(a) at least one substrate comprising a body which is formed of sheet-like plastic fabric, the plastic fabric having been molded into a shape as a non-planar three-dimensional surface and being stiff enough to hold the shape as a non-planar three-dimensional surface and which is provided with an array of points which easily accept the passage of a thread-bearing tool, (b) an assortment of colored threads, and (c) an assortment of threads-manipulating tools.

2. A method of forming a craft item comprising the steps of:

(a) forming at least one substrate comprising a body which is formed of sheet-like plastic fabric, the plastic fabric having been molded into a shape as a non-planar three-dimensional surface and being stiff enough to hold the shape as a non-planar three-dimensional surface and which is provided with an array of aperatures to accept the passage of a thread-bearing tool, and (b) attaching decorative meaterial to the surface.

3. A method of forming a craft item comprising the steps of:

(a) forming at least one substrate comprising a body which is formed of sheet-like plastic fabric, the plastic fabric having been molded into a shape as a non-planar three-dimensional surface and being stiff enough to hold the shape as a three-dimensional surface and which is provided with an array of aperatures to accept the passage of a thread-bearing tool, and (b) passing a thread-manipulating tool carrying thread through at least two of the aperatures to attach the thread to the surface.

* * * * *